US010252338B2

(12) United States Patent
Kobayashi et al.

(10) Patent No.: US 10,252,338 B2
(45) Date of Patent: Apr. 9, 2019

(54) METHOD OF MANUFACTURING SINTERING DIFFUSION JOINING MEMBER AND MANUFACTURING APPARATUS OF THE SAME

(71) Applicant: DENSO CORPORATION, Kariya, Aichi-pref. (JP)

(72) Inventors: Eiichi Kobayashi, Okazaki (JP); Kunihiro Kodama, Nagoya (JP); Masashi Totokawa, Nagoya (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 600 days.

(21) Appl. No.: 14/747,016

(22) Filed: Jun. 23, 2015

(65) Prior Publication Data

US 2016/0001367 A1 Jan. 7, 2016

(30) Foreign Application Priority Data

Jun. 26, 2014 (JP) ..... 2014-131430

(51) Int. Cl.

| | |
|---|---|
| ***B22F 7/04*** | (2006.01) |
| ***B22F 3/16*** | (2006.01) |
| ***B22F 7/08*** | (2006.01) |
| ***B22F 3/03*** | (2006.01) |
| *B22F 3/02* | (2006.01) |

(52) U.S. Cl.

CPC ..... *B22F 7/08* (2013.01); *B22F 3/03* (2013.01); *B22F 2003/023* (2013.01); *B22F 2003/031* (2013.01)

(58) Field of Classification Search

CPC ..... B22F 7/08; B22F 3/03

USPC ..... 418/8

See application file for complete search history.

(56) References Cited

U.S. PATENT DOCUMENTS 4,556,532 A * 12/1985 Umeha ..... B22F 7/062 419/30
5,064,608 A * 11/1991 Suzuki ..... B22F 7/062 419/14
6,475,427 B1 * 11/2002 Deshmukh ..... A63B 53/04 419/8

(Continued)

FOREIGN PATENT DOCUMENTS

JP 63004005 A * 1/1988
JP 06-330108 11/1994

(Continued)

*Primary Examiner* — Colleen P Dunn
*Assistant Examiner* — Jeremy C Jones
(74) *Attorney, Agent, or Firm* — Harness, Dickey & Pierce, P.L.C.

(57) ABSTRACT

In S102, after preforming a pressed powder member by compressing metal powder filled in a press-forming portion, the pressed powder member and metal member are slid to each other in S103. In S104, after temporarily joining the pressed powder member and the metal member by further pressurizing the powder member, the temporary joined pressed powder member and the metal member are sintered in a sintering furnace, and the pressed powder member and the metal member are joined by sintering diffusion in S105. Thereby, joining areas between the pressed powder member and the metal member are increased, and it is possible to improve a joining strength between the pressed powder member and the metal member.

8 Claims, 6 Drawing Sheets

(56) References Cited

U.S. PATENT DOCUMENTS

| | | | | |
|---|---|---|---|---|
| 2005/0036893 | A1* | 2/2005 | Decker | B22F 5/04 416/244 A |
| 2009/0196761 | A1* | 8/2009 | James | B22F 5/009 416/241 R |
| 2010/0224146 | A1* | 9/2010 | Kuwahara | B22F 7/062 123/90.6 |
| 2014/0232034 | A1* | 8/2014 | Kusawake | B30B 15/0011 264/109 |

FOREIGN PATENT DOCUMENTS

| | | |
|---|---|---|
| JP | 2004-002973 | 1/2004 |
| JP | 2004-197157 | 7/2004 |
| JP | 2010144241 A | 7/2010 |

* cited by examiner

METHOD OF MANUFACTURING SINTERING DIFFUSION JOINING MEMBER AND MANUFACTURING APPARATUS OF THE SAME

CROSS-REFERENCE TO RELATED APPLICATION

This application is based on and claims the benefit of priority from earlier Japanese Patent Application No. 2014-131430 filed Jun. 26, 2014, the description of which is incorporated herein by reference.

TECHNICAL FIELD

The present disclosure relates to a method of manufacturing a sintered diffusion joining member to which a pressed powder member formed by compressing metal powder and a metal member are joined by sintering, and a manufacturing apparatus of the sintering diffusion joining member.

BACKGROUND

A method of sintering diffusion joining for joining an integrated pressed powder member formed into a desired shape by compressing metal powder and a metal member by sintering is known.

In the method of sintering diffusion joining, at first, the pressed powder member formed into the desired shape by compressing the metal powder is temporarily joined to the metal member formed by metallic forming or machining.

Then, the temporarily joined pressed powder member and the metal member is joined by sintering.

For example, a method of manufacturing a sintered diffusion joining member that joins a metal member and a pressed powder member by sintering diffusion joining using frictional heat generated by a relative movement of the metal member and the pressed powder member while in contact with each other in a predetermined pressure is disclosed in Japanese Patent Application Laid-Open Publication No. 2004-002973.

However, in the method of manufacturing the sintered diffusion joining member disclosed in the Publication No. '973, the frictional heat as a heat source necessary for sintering the pressed powder member and the metal member is generated by moving the metal member at high-speed while in contact with the pressed powder member.

Therefore, a device that can move at least either one of the pressed powder member and the metal member at high-speed with high accuracy is required, and thus the manufacturing cost of the sintered diffusion joining member increases.

Moreover, in order to reliably join in a sintering stage after the frictional heat is generated, a complex control which can suddenly stop the fast moving metal member is required.

In addition, if the frictional heat is not sufficiently generated, there is a possibility that a joining strength between the pressed powder member and the metal member drops.

SUMMARY

An embodiment provides a method of manufacturing a sintered diffusion joining member that improves a joining strength between a pressed powder member formed by compressing metal powder and a metal member.

In a method of manufacturing a sintered diffusion joining member to which a pressed powder member formed by compressing a metal powder and a metal member are joined by sintering according to a first aspect, the method includes a sliding process that slides one member of either the pressed powder member or the metal member relative to the other member while applying a first acting force to the pressed powder member and the metal member, a pressurizing process that temporarily joins the pressed powder member and the metal member while pressurizing the pressed powder member by a second acting force after the sliding process, and a sintering process that sinters the temporarily joined pressed powder member and the metal member after the pressurizing process.

In the method of manufacturing the sintered diffusion joining member of the present disclosure, one member of either the pressed powder member or the metal member is slid to the other member while applying the first acting force in the sliding process.

At this time, at an interface where the pressed powder member and the metal member slide, an oxide film formed on a surface of the metal member or impurities adhered to the surface is removed.

At the same time, a surface shape of one member of either the pressed powder member or the metal member is transferred to a surface of the other member so that a surface shape of the pressed powder member becomes the same as the surface shape of the metal member.

Thereby, joining areas between the pressed powder member and the metal member increase, and it is possible to improve the joining strength when sintering the pressed powder member and the metal member in the sintering process.

Thus, in the manufacturing method of the sintered diffusion joining member according to the present disclosure, it is not necessary to control the movement of either the pressed powder member or the metal member with high accuracy like the method of manufacturing the sintered diffusion joining member according to the Publication No. 2004-002973.

Therefore, it is possible to easily increase the joining strength between the metal member and the powder component.

Further, a process for improving the joining strength is performed prior to the pressurizing process that temporarily joins the pressed powder member and the metal member, and the joining strength is reliably improved in the subsequent sintering process.

Therefore, it is possible to easily increase the joining strength between the metal member and the powder component.

In a manufacturing apparatus of the sintering diffusion joining member to which a pressed powder member formed by a compressed metal powder and a metal member are joined by sintering according to a second aspect, the apparatus includes a metal member supporting unit that supports the metal member so that the metal member contacts with the pressed powder member accommodated in the press forming portion, and a driving unit that slides one member of either the pressed powder member accommodated in the press forming portion or the metal member supported by the metal member supporting unit relative to the other member.

The pressed powder member and the metal member are slid to each other while applying a first acting force to the pressed powder member or the metal member.

In the manufacturing apparatus of the sintering diffusion joining member of the present disclosure, the pressed powder member is slid to the metal member while applying the first acting force when temporary joining the pressed powder member and the metal member prior to sintering.

Thereby, at an interface where the pressed powder member and the metal member slide, an oxide film formed on a surface of the metal member or impurities adhered to the surface is removed.

At the same time, a surface shape of one member of either the pressed powder member or the metal member is transferred to a surface of the other member so that a surface shape of the pressed powder member becomes the same as the surface shape of the metal member.

Therefore, joining areas between the pressed powder member and the metal member increase, and it is possible to easily increase the joining strength between the metal member and the powder component.

DETAILED DESCRIPTION OF THE PREFERRED EMBODIMENTS

Figure 1:
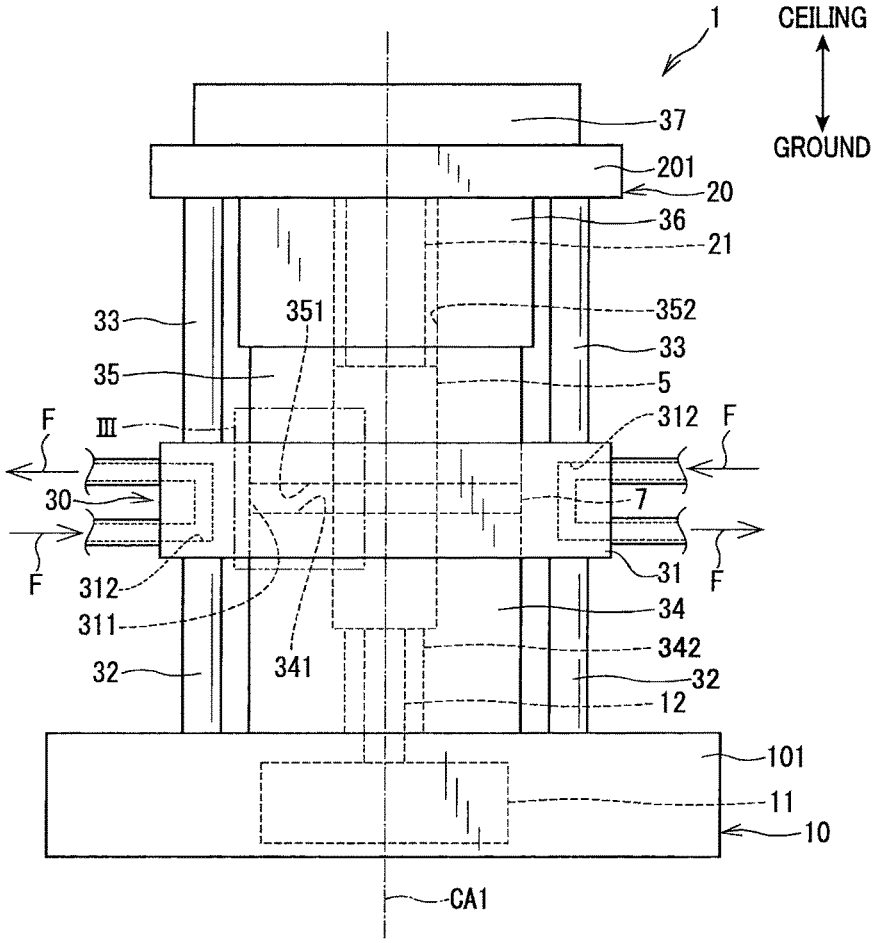
FIG. 1 shows a schematic diagram of a manufacturing apparatus of a sintered diffusion joining member according to an embodiment of the present disclosure.

An embodiment according to the present disclosure will be described with reference to drawings.

Embodiment

First, a manufacturing apparatus of a sintered diffusion joining member according to an embodiment of the present disclosure will be described with reference to FIG. 1.

A temporary joining device 1 as the manufacturing apparatus for the sintering diffusion joining member is a device that temporarily joins a rod-like metal member 5 formed by metallic forming and a pressed powder member 7 formed into substantially annular shape by compressing metal powder prior to sintering in a sintering furnace (not shown), for example, in a method of manufacturing the sintered diffusion joining member described later.

The temporary joining device 1 includes a rotation driving unit 10 as a driving unit, a metal member supporting unit 20, and a press forming portion 30.

Hereinafter, the present embodiment will be described defining that an upper side of FIGS. 1, 3-5 as a ceiling side and a lower side of FIGS. 1, 3-5 as a ground side.

The rotation driving unit 10 includes a lower base portion 101, a rotary motor 11, and a shaft 12.

The lower base portion 101 is located in the ground side of the temporary joining device 1.

The lower base portion 101 has the metal member supporting unit 20 and the press forming portion 30 in the ceiling side thereof.

The rotary motor 11 is accommodated in the lower base portion 101.

The rotary motor 11 generates a rotational driving force when power is supplied from an external power source (not shown).

The rotary driving force is output to the shaft 12 that is connected with the rotary motor 11 in the ceiling side of the rotary motor 11.

An end portion in the ground side of the shaft 12 is connected to the rotary motor 11, and an end portion in the ceiling side of the shaft 12 is projected from the lower base portion 101 in the ceiling side direction.

The metal member 5 is engaged with the end portion in the ceiling side of the shaft 12.

The rotation driving unit 10 rotates the metal member 5 via the shaft 12.

A rotational speed of the rotation driving unit 10 that rotates the metal member 5 is a relatively low speed, which is 60 rpm or less, for example.

The metal member supporting unit 20 includes an upper base portion 201, and a position adjustor 21.

The upper base portion 201 is located in the ceiling side of the temporary joining device 1.

The position adjustor 21 is disposed so as to extend from the upper base portion 201 to the ground side direction.

An end portion in the ground side of the position adjustor 21 is in contact with an end portion in the ceiling side of the metal member 5.

The position adjustor 21 adjusts a position of the metal member 5 relative to the pressed powder member 7 accommodated inside the press forming portion 30.

The press forming portion 30 includes a die 31, die support portions 32 and 33, a lower punch portion 34, an upper punch portion 35, a piston portion 36, and a pressure generator 37.

The die 31 is a metallic annular member, and is disposed between the lower base portion 101 and the upper base portion 201.

The die 31 is disposed in a predetermined position, specifically, a position where the pressed powder member 7 is temporarily joined to the metal member 5 by a plurality of die support portions 32 and 33. The die support portions 32 and 33 are formed substantially in columnar shapes. The die support portions 32 are disposed on the ceiling side of the lower base portion 101, and the die support portions 33 are disposed on the ground side of the upper base portion 201.

An inner wall 311 radially inside of the die 31 forms a filling space where the metal powder that forms the pressed powder member 7 is filled.

In addition, the die 31 has flow paths 312 where fluid flows.

Cooling fluid for lowering the temperature of the die 31 is supplied to the flow paths 312 from a fluid supply source (not shown).

The lower punch portion 34 is a substantially cylindrical metal member disposed on the ceiling side of the lower base portion 101.

A through-hole 342 is formed in the lower punch portion 34 along a direction of a central axis CA1 of the temporary joining device 1.

The shaft 12 is inserted through the through-hole 342.

Figure 3:
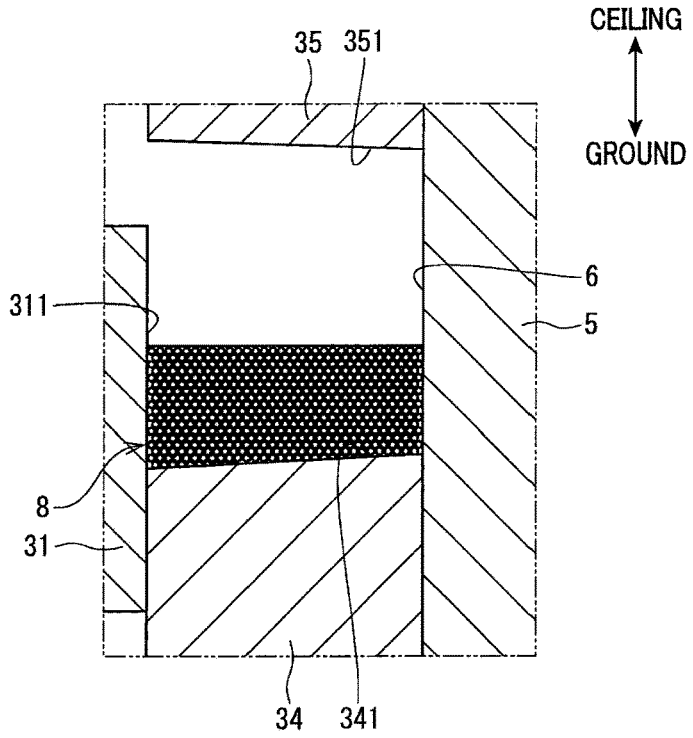
FIG. 3 shows a schematic diagram for describing an operation of the manufacturing apparatus of the sintering diffusion joining member in the manufacturing method of the sintered diffusion joining member according to the embodiment of the present disclosure.
Figure 4:
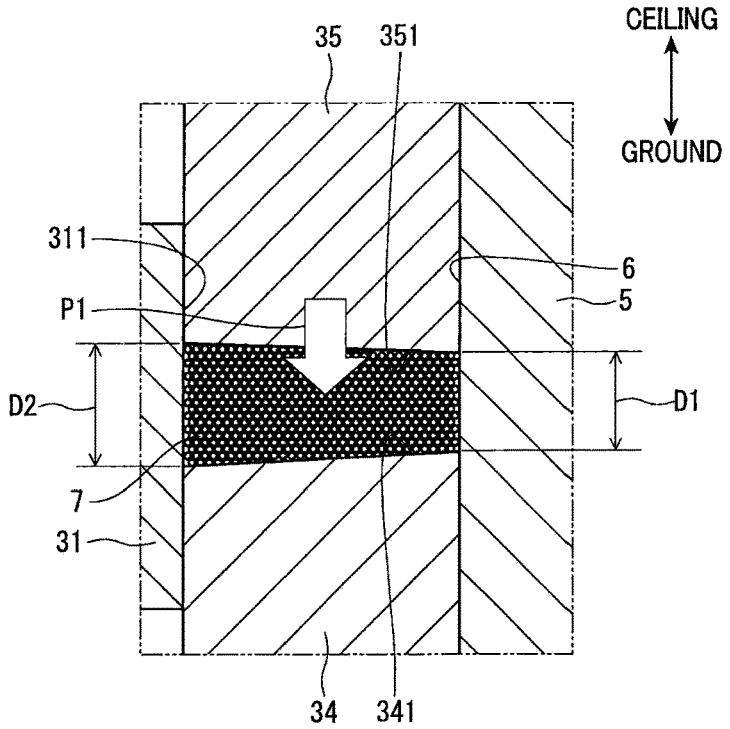
FIG. 4 shows a schematic diagram for describing the operation of the manufacturing apparatus of the sintering diffusion joining member in the manufacturing method of the sintered diffusion joining member according to the embodiment of the present disclosure, and shows different schematic diagram as FIG. 3.
Figure 5:
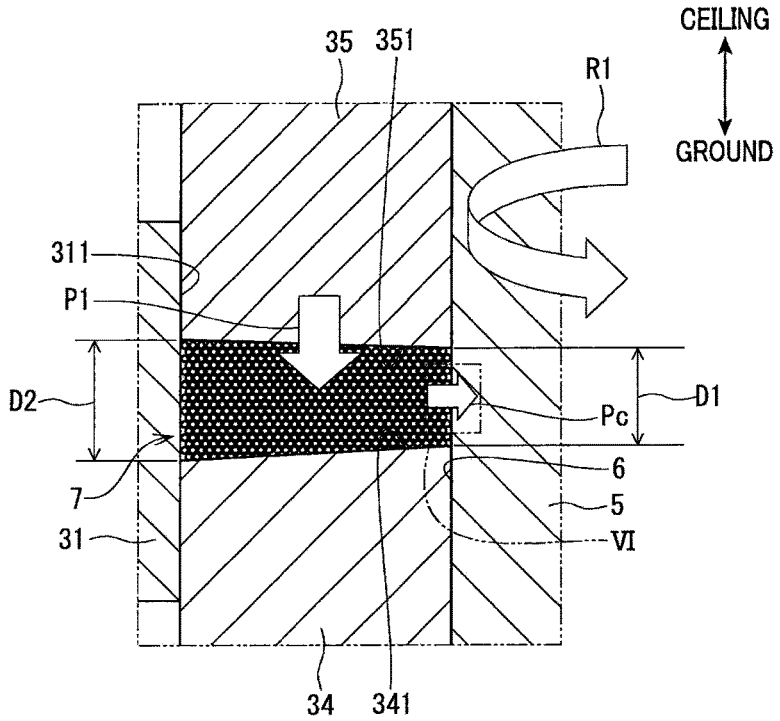
FIG. 5 shows a schematic diagram for describing the operation of the manufacturing apparatus of the sintering diffusion joining member in the manufacturing method of the sintered diffusion joining member according to the embodiment of the present disclosure, and shows different schematic diagram as FIGS. 3 and 4.

An end surface 341 in the ceiling side of the lower punch portion 34 is formed so as to incline to the ground side from a radially inner end portion toward a radially outward end portion, as shown in FIGS. 3-5.

The upper punch portion 35 is a substantially cylindrical metal member disposed on the ground side of the upper base portion 201.

The upper punch portion 35 is disposed reciprocally movable in a vertical direction (ceiling-ground direction), as shown in FIGS. 3-5.

A through-hole 352 is formed in the upper punch portion 35 along the direction of the central axis CA1.

The position adjustor 21 is inserted into the through hole 352.

An end surface 351 in the ground side of the upper punch portion 35 is formed so as to incline to the ceiling side from a radially inner end portion toward a radially outward end portion, as shown in FIGS. 3-5.

In a preforming of the pressed powder member 7 in the method of manufacturing the sintered diffusion joining member, which will be described later, when the upper punch portion 35 and the lower punch portion 34 are the closest, a sectional shape including the center axis CA1 of the filling space where the pressed powder member 7 is formed becomes a trapezoidal shape, as shown in FIGS. 4 and 5.

At this time, as shown in FIGS. 4 and 5, the sectional shape of the filling space has a length D2 longer than a length D1 in the central axis CA1 direction. The length D1 is a length where the pressed powder member 7 in a radially inner side, which is a side where the pressed powder member 7 and the metal member 5 are contacting.

The length D2 is a length where the pressed powder member 7 in a radially outer side, which is an opposite side to the side where the pressed powder member 7 and the metal member 5 are contacting. The length D2 is configured to be 1.3 times the length D1 or less.

The pressure generator 37 is positioned on the ceiling side of the upper base portion 201.

The pressure generator 37 is coupled to the upper punch portion 35 via the piston portion 36.

The pressure generator 37 moves the upper punch portion 35 in the vertical direction, as well as applies a pressure to the upper punch portion 35 that press-forms the pressed powder member 7.

Next, the method of manufacturing the sintering diffusion joining member according to the present embodiment will be described.

Figure 2:
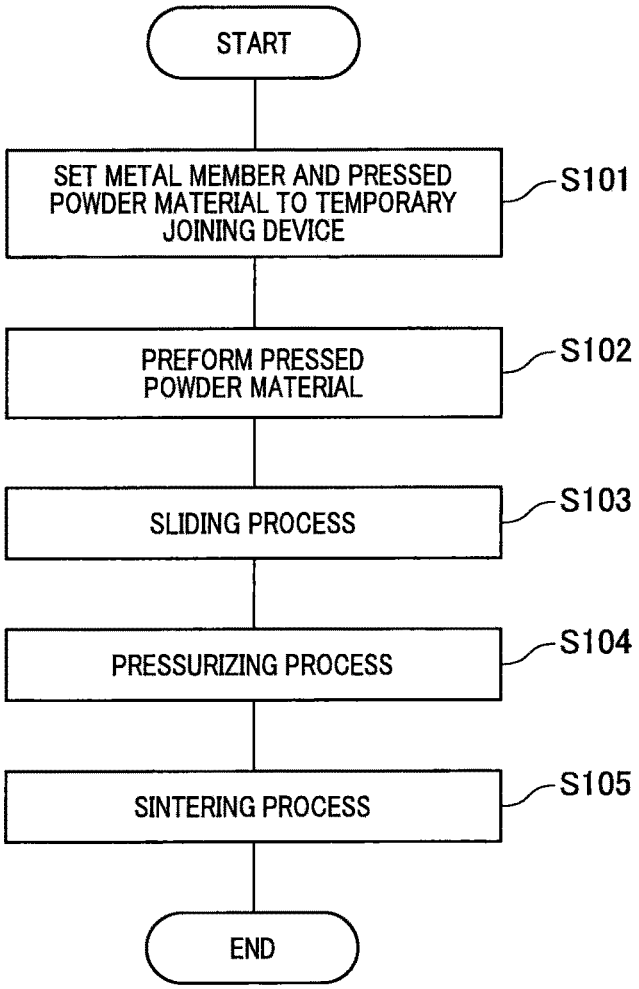
FIG. 2 shows a flow chart of a method of manufacturing the sintered diffusion joining member according to the embodiment of the present disclosure.

A flow chart of the method of manufacturing the sintered diffusion joining member is shown in FIG. 2.

An enlarged view of an essential part of the temporary joining device 1 (III part in FIG. 1) during manufacturing the sintered diffusion joining member according to the flowchart shown in FIG. 2 is shown in FIGS. 3-5.

First, in a step (hereinafter, referred to as "S") 101, a pressed powder material 8, such as metal powder 81 (refer to FIG. 6) that forms the pressed powder member 7 or a resin powder that reduces a spring back during the press-forming, and the metal member 5 are set to the temporary joining device 1.

At this time, in a relative positional relationship between the pressed powder material 8 and the metal member 5, either one may be positioned in an inner side.

In S101, first, the metal member 5 that is formed by forging, for example, and is washed with a hydrocarbon based cleaning fluid, is set to the temporary joining device 1 so as to be connected with the end portion in the ceiling side of the shaft 12, and the position of the metal member 5 is adjusted by the position adjustor 21.

Next, Fe—Cu—C based metal powder as the metal powder and zinc stearate powder as the resin powder are filled as the pressed powder material 8, for example, into a substantially annular filling space formed by an outer wall 6 of the metal member 5 in the radially outer side, the end surface 341 of the lower punch portion 34, and the inner wall 311 of the die 31 (FIG. 3).

Next, in S102, the pressed powder material 8 being filled is preformed.

In S102, the pressure that the pressure generator 37 generates is applied to the upper punch portion 35, the pressed powder material 8 is sandwiched between the lower punch portion 34 and the upper punch portion 35, and the pressed powder material 8 is pressurized by a first surface pressure P1 (FIG. 4).

The first surface pressure P1, for example, is 400 MPa.

Thereby, the pressed powder member 7 capable of maintaining the substantially annular shape without being damaged even when some extent magnitude of force is applied thereto is preformed.

Next, in S103, the pressed powder member 7 and the metal member 5 are slid to each other as a sliding process.

Specifically, the rotary motor 11 is driven while applying the first surface pressure P1 onto the pressed powder member 7 in S102.

The metal member 5 is rotated in a circumferential direction shown by a white arrow R1 in FIG. 5 by the rotational driving force generated by the rotary motor 11.

The rotational speed at this time is relatively slow, which is 10 rpm, for example, and a rotational time is 4 seconds.

That is, a rotation of the metal member 5 relative to the pressed powder member 7 is less than once.

A sliding distance as a moving distance of the metal member 5 relative to the pressed powder member 7 at this time is configured to be 300 mm or less.

When the rotation direction of the metal member 5, that is, the sliding direction is in the circumferential direction, it is possible to obtain enough sliding distance, and it is easy to obtain enough distance of the sliding process.

Figure 6:
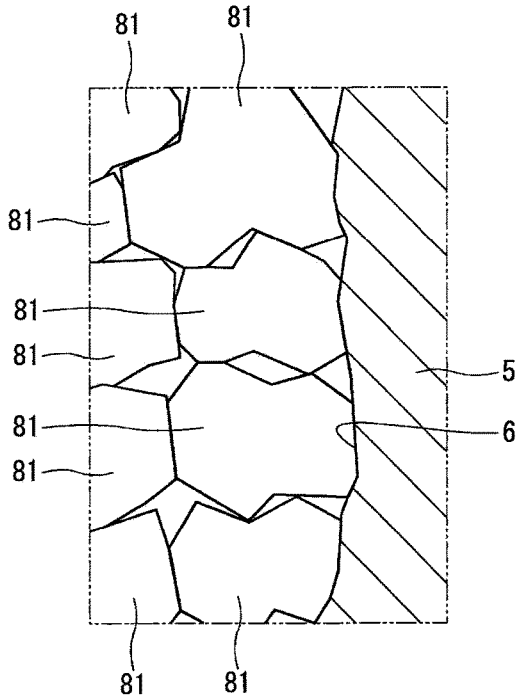
FIG. 6 shows a sectional view of an interface between a pressed powder member and a metal member in the method of manufacturing the sintered diffusion joining member according to the embodiment of the present disclosure.

A sectional view of an interface between the pressed powder member 7 and the metal member 5 when the preformed pressed powder member 7 and the metal member 5 are sliding to each other is shown in FIG. 6.

As shown in FIG. 6, the outer wall 6 of the metal member 5 rotates relative to the pressed powder member 7 of which the position is relatively fixed in the press forming portion 30, and a surface of the outer wall 6 becomes new by the metal powder 81 contained in the pressed powder member 7.

Specifically, impurities such as oxide film formed on the outer wall 6 or a parting agent adhered thereto are removed, and waviness is formed on the surface of the outer wall 6 so as to follow a surface shape of the metal powder 81.

Further, when the pressed powder member 7 and the metal member 5 are sliding to each other, a cooling fluid, such as water flows in the flow paths 312 that the die 31 is provided with so that the temperature of the inner wall 311 of the die 31 where the pressed powder member 7 contact becomes the temperature lower than the melting point of zinc stearate contained in the pressed powder member 7.

It should be noted that flows of cooling fluid are shown by arrows F in FIG. 1.

Next, in S104, the pressed powder member 7 is further pressurized as a pressurizing process.

Specifically, a second surface pressure as a second acting force that the upper punch portion 35 applies on the pressed powder member 7 by the pressure generator 37 is configured to be 700 MP, the temperature of the pressed powder member 7 is configured to be equal to or higher than 60 degrees C. while the pressed powder member 7 is pressurized to a desired density, and the pressed powder member 7 and the metal member 5 are temporarily joined.

Incidentally, the second surface pressure is set to be larger than a sliding surface pressure Pc as a first acting force, which will be described later.

From a relationship of the acting forces, it is possible to slide the pressed powder member 7 under pressure in the sliding process, and the pressed powder member 7 can be pressed together with the metal member 5 in the pressurizing process.

Next, in S105, as a sintering process, the temporarily joined pressed powder member 7 and the metal member 5 are set in a vacuum sintering furnace (not shown), and sintered for one hour in an environment of the temperature of 1200 degrees C.

Thereby, the pressed powder member 7 and the metal member 5 are joined by sintered diffusion, and the sintering diffusion joining member is formed.

[Experimental Result 1]

In the temporary joining device 1, inventors of the present disclosure have conducted an experiment to examine a change in a joining strength between the pressed powder member 7 and the metal member 5 after the sintering process relative to a change of the first surface pressure applying on the pressed powder member 7 in the sliding process.

Figure 7:
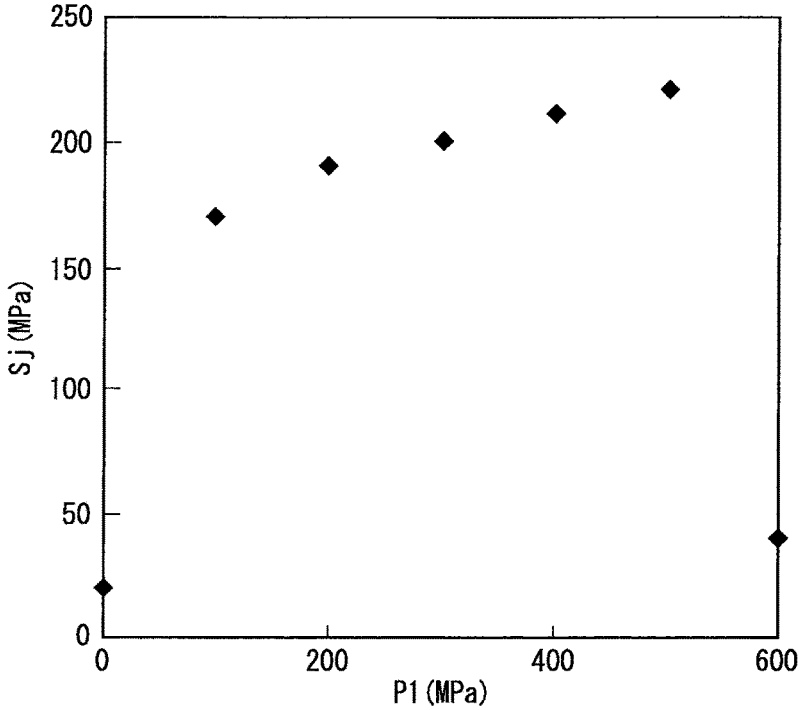
FIG. 7 shows a characteristic diagram of a relationship between a first surface pressure and a joining strength in the method of manufacturing the sintered diffusion joining member according to the embodiment of the present disclosure.

The result is shown in FIG. 7.

In FIG. 7, a horizontal axis represents the first surface pressure P1 applying on the pressed powder member 7 in the sliding process, and a vertical axis represents the joining strength Sj of the pressed powder member 7 and the metal member 5 after the sintering process.

As shown in FIG. 7, when the first surface pressure P1 is 0 MPa, the joining strength Sj is a relatively small value of about 20 MPa, however, it is revealed that when the first surface pressure P1 is 100, 200, 300, 400, 500 MPa, the joining strength Sj becomes a relatively large value of about 160-220 MPa.

[Experimental Result 2]

Moreover, in the temporary joining device 1, the inventors have conducted an experiment to examine a relationship between the sliding distance and the joining strength of the metal member 5 relative to the pressed powder member 7.

Figure 8:
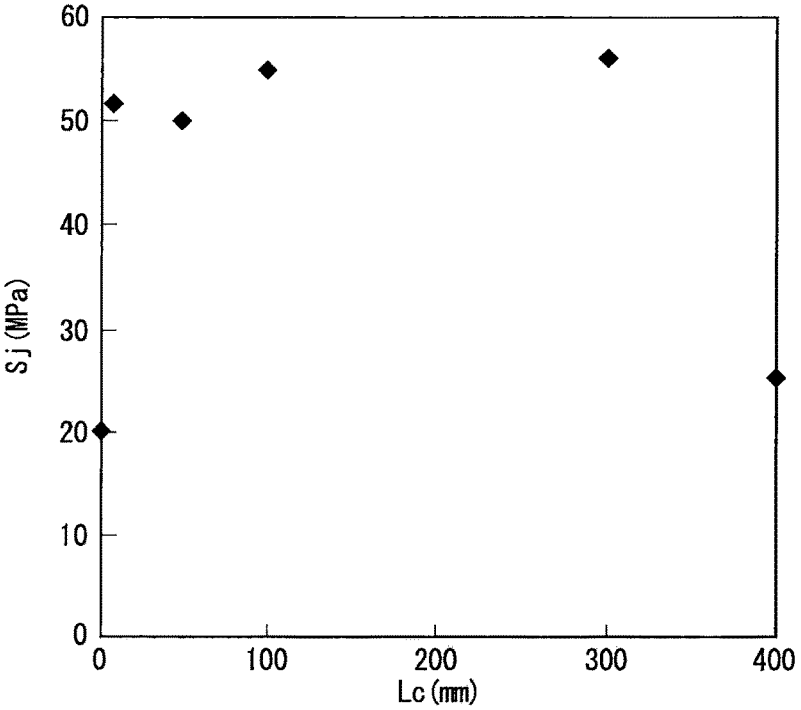
FIG. 8 shows a characteristic diagram of a relationship between a sliding distance and the joining strength in the method of manufacturing the sintered diffusion joining member according to the embodiment of the present disclosure.

The result is shown in FIG. 8.

In FIG. 8, a horizontal axis represents the sliding distance Lc of the metal member 5 relative to the pressed powder member 7, and a vertical axis represents the joining strength Sj of the pressed powder member 7 and the metal member 5 after the sintering process.

Here, the sliding distance Lc is a distance that the metal member 5 travels while in contact with the pressed powder member 7 relative to the fixed pressed powder member 7.

As shown in FIG. 8, when the sliding distance Lc is 0 mm, the joining strength Sj is about 20 MPa, however, it is revealed that when the sliding distance Lc is greater than 0 mm and equal to or less than 300 mm, the joining strength Sj becomes greater than 50 MPa.

In addition, when the sliding distance Lc is 400 mm, it is revealed that the joining strength Sj drops.

[Experimental Result 3]

Moreover, in the temporary joining device 1, the inventors have conducted an experiment to examine a relationship between an amount of the zinc stearate contained in the pressed powder material 8 and the joining strength.

Figure 9:
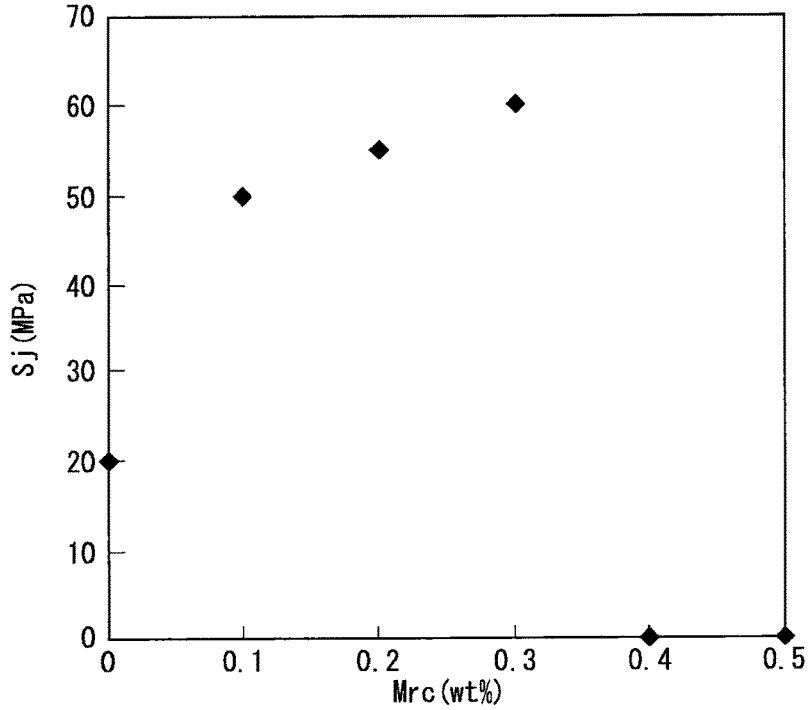
FIG. 9 shows a characteristic diagram of a relationship between a content of resin and the joining strength in the method of manufacturing the sintered diffusion joining member according to the embodiment of the present disclosure.

The result is shown in FIG. 9.

In FIG. 9, a horizontal axis represents the amount of the zinc stearate Mrc contained in the pressed powder member 7, and a vertical axis represents the joining strength Sj of the pressed powder member 7 and the metal member 5 after the sintering process.

As shown in FIG. 9, as the amount of zinc stearate Mrc increases from 0 wt % to 0.3 wt %, the joining strength Sj increases.

In particular, when the amount of the zinc stearate Mrc is 0.1, 0.2, or 0.3 wt %, the joining strength Sj becomes about 2.5-3 times larger compared to when the amount of the zinc stearate Mrc is 0 wt %.

On the other hand, when the amount of the zinc stearate Mrc is greater than 0.3 wt %, that is 0.4 or 0.5 wt %, it is revealed that the joining strength Sj almost becomes zero.

[Experimental Result 4]

Further, in the temporary joining device 1, the inventors have conducted an experiment to examine a relationship between a forming temperature of the pressed powder member 7 in the sliding process and the pressurizing process, and the joining strength.

Figure 10:
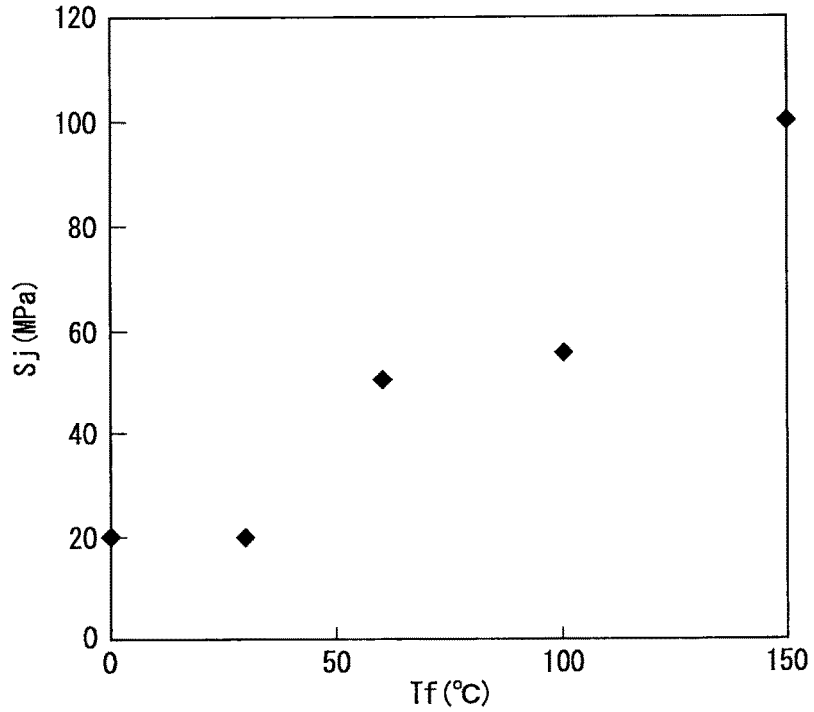
FIG. 10 shows a characteristic diagram of a relationship between forming temperature of the pressed powder member and the joining strength in the method of manufacturing the sintered diffusion joining member according to the embodiment of the present disclosure.

The result is shown in FIG. 10.

In FIG. 10, a horizontal axis represents the forming temperature Tf that is the temperature radially inside of the pressed powder member 7 in the sliding process and the pressurizing process, and a vertical axis represents the joining strength Sj of the pressed powder member 7 and the metal member 5 after the sintering process.

As shown in FIG. 10, when the forming temperature Tf of the pressed powder member 7 is 0 or 30 degrees C., the joining strength Sj is about 20 MPa, however, it is revealed that when the forming temperature Tf is 60 degrees C. or higher, the joining strength becomes a large value of about 50-60 MPa.

In the method of manufacturing the sintered diffusion joining member according to the embodiment, when sliding the metal member 5 and the pressed powder member 7, the sliding surface pressure Pc as the first acting force that has a causal relationship with a magnitude of the first surface pressure P1 acts on the interface between the metal member 5 and the pressed powder member 7.

Here, the sliding surface pressure Pc is a surface pressure that acts between the metal member 5 and the pressed powder member 7 by applying the pressure to the pressed powder member 7 by the upper punch portion 35 in a direction substantially perpendicular to the central axis CA1 (see FIG. 5).

Contaminations such as the oxide film formed on the surface of the outer wall 6 of the metal member 5 or the parting agent adhered thereto are removed by the sliding surface pressure Pc.

Further, when the pressed powder member 7 is pressed against the outer wall 6 of the metal member 5 at a relatively low rotating speed of about 10 rpm during the sliding surface pressure Pc is applying, as shown in FIG. 6, shapes of surfaces of the metal powder 81 that constitutes the pressed powder member 7 are transferred to the outer wall 6 of the metal member 5.

Thereby, an area where the pressed powder member and the metal member 5 contact when they are temporarily joined becomes wider.

Thus, in the method of manufacturing the sintered diffusion joining member according to the embodiment, in the interface where the pressed powder member 7 and the metal member 5 join, a surface of the metal member 5 is renewed, and it is possible to improve the joint strength due to the sintering diffusion joining by increasing joining areas.

Further, in the manufacturing method of the sintered diffusion joining member according to the embodiment, the sliding of the metal member 5 relative to the pressed powder member 7 is performed in relatively slow speed, while applying the sliding surface pressure Pc of about 200 MPa, which is approximately a half of the first surface pressure P1, to the interface between the pressed powder member 7 and the metal member 5.

Thereby, as shown in FIG. 7, it is possible to improve the joining strength between the pressed powder member 7 and the metal member 5.

Therefore, unlike the method of manufacturing the sintered diffusion joining member according to the Publication No. '973 that has the driving unit for accurately controlling the sliding of the metal member relative to the pressed powder member at a high speed including a sudden stop, it is possible to easily manufacture the sintered diffusion joining member.

Moreover, since the driving unit that controls with high accuracy is not required, it is possible to reduce the manufacturing cost of the sintered diffusion joining member.

In the manufacturing method of the sintering diffusion joining member according to the embodiment, the sliding distance of the metal member 5 relative to the pressed powder member 7 is configured to be 300 mm or less in the sliding process.

Thereby, as shown in FIG. 8, it is possible to improve the joining strength between the pressed powder member 7 and the metal member 5.

In the method of manufacturing the sintered diffusion joining member according to the embodiment, the forming temperature of the pressed powder member 7 is configured to be equal to or higher than 60 degrees C.

Thereby, the pressed powder member 7 where the rod-like metal member 5 is inserted is formed so as to spread in the radially inward direction, the pressed powder member 7 is reliably joined temporarily to the metal member 5.

Therefore, as shown in FIG. 10, it is possible to improve the joining strength between the pressed powder member 7 and the metal member 5.

In the method of manufacturing the sintered diffusion joining member according to the embodiment, the powder of zinc stearate is included in addition to the metal powder 81 as the pressed powder material 8.

Since the spring-back of the zinc stearate powder is larger than that of the metal powder, the pressed powder member is easily deformed when taking out the pressed powder member after press-forming when many zinc stearate powder is included.

In the method of manufacturing the sintered diffusion joining member according to the embodiment, as shown in FIG. 9, the joint strength can be improved while suppressing the deformation due the spring-back by configuring a content of the zinc stearate to 0.3 wt % or less.

In the temporary joining device 1 according to the embodiment, while maintaining the temperature of the inner wall 311 of the die 31 at below 60 degrees C., which is less than the melting point of the zinc stearate, by using the flow paths 312 that the die 31 has in the sliding process and the pressurizing process, the pressed powder member 7 is temporarily joined to the metal member 5.

Thereby, the zinc stearate powder included in the radially outer side of the pressed powder member 7 can be prevented from liquefying, and it is possible to control the flow of the metal powder 81 in the pressed powder member 7.

Therefore, it is possible to improve the joining strength between the metal member 5 and the pressed powder member 7.

In addition, in the temporary joining device 1, when the upper punch portion 35 and the lower punch portion 34 are the closest in the preforming of the pressed powder member 7, the filling space is formed by the end surface 341 in the ceiling side of the lower punch portion 34 and the end face 351 in the ground side of the upper punch section 35.

The sectional shape including the center axis CA1 of the filling space has a length in the direction of the center axis CA1, and the length becomes longer as the length moves from the radially inner side towards the radially outward side.

When the pressed powder member 7 filled in the filling space formed by the end surface 341 in the ceiling side of the lower punch portion 34 and the end face 351 in the ground side of the upper punch section 35 is press-formed, densities of the metal powder and the zinc stearate powder of the pressed powder member 7 becomes smaller in a portion at radially outer side compared with a portion at the radially inner side.

At this time, since the zinc stearate powder applying as the parting agent moves from the radially inner side to the radially outer side of the press forming portion 30, the radially outer side of the pressed powder member 7 can be reliably removed from the press forming portion 30.

Other Embodiments (A) In the embodiment described above, the Fe—Cu—C-based metal powder is used as the metal powder, and the zinc stearate powder is used as the resin powder. However, metal powder and resin powder constituting the pressed powder member are not limited thereto.

(B) In the embodiment described above, the shape of the metal member is to be the rod-like shape.

In addition, the shape of the pressed powder member is to be the substantially annular shape having a through hole to which the rod-like metal member is inserted.

However, the shapes of the metal member and the pressed powder member are not limited thereto.

(C) In the embodiment described above, the die that the temporary joining device has includes the flow paths where the cooling fluid flows, and the temperature of the inner wall of the die that contacts the pressed powder member is configured to be lower than the melting point of the zinc stearate.

However, the flow paths may not be necessary, and the temperature of the inner wall of the die that contacts the pressed powder member may be a temperature to be equal to or higher than the melting point of the zinc stearate.

(D) In the embodiment described above, the first surface pressure is configured to be 400 MPa.

However, the magnitude of the first surface pressure is not limited thereto.

As shown in FIG. 7, although the joining strength relatively improves when the sliding surface pressure, which is approximately a half of the first surface pressure, is 100 MPa or more and is 500 MPa or less, the sliding surface pressure is not limited to be within this range.

(E) In the embodiment described above, the metal member and the pressed powder member are slid by rotating the metal member relative to the pressed powder member in the sliding process.

However, a method of sliding the metal member relative to the pressed powder member is not limited thereto.

It may be a reciprocating movement.

(F) In the embodiment described above, the rotational speed of the metal member in the sliding process is to be a relatively low speed of 10 rpm, and the rotational time to be 4 seconds.

However, the rotation speed and the rotation time of the metal member are not limited thereto.

It may be rotated at a relatively low rotational speed of less than 60 rpm.

(G) In the embodiment described above, the metal member is configured to be rotated relative to the pressed powder member.

However, a relationship between a relative movement of these items is not limited thereto.

The powder member may be moved relative to the fixed metal member, or both the metal member and the pressed powder member may be moved.

Further, in the embodiment described above, the sliding direction of the metal member 5 in the sliding process is configured to be the circumferential direction.

However, the sliding direction of the metal member 5 may be in the axial direction of the metal member 5.

When the sliding direction of the metal member 5 is the circumferential direction, the outer surface shape of the metal member 5 is necessary to be a round shape, however, when the sliding direction is the axial direction, it is possible to perform the sliding process even if the outer surface shape is other than round, such as a rectangular.

(H) In the embodiment described above, the forming temperature of the pressed powder member in the pressurizing process is configured to be at 60 degrees C. or higher.

However, the lower limit of the forming temperature is not limited to 60 degrees C.

(I) In the embodiment described above, when pre-forming the pressed powder member, the sectional shape including the center axis of the filling space where the pressed powder member is formed is to become the trapezoidal shape when the lower punch portion and the upper punch portion are the closest.

However, the sectional shape including the center axis of the filling space where the pressed powder member is formed is not limited thereto.

For example, the sectional shape may be a rectangular shape.

The present disclosure is not limited to such an embodiment and can be embodied in various forms within the scope not departing from the content thereof.

What is claimed is:

1. A method of manufacturing a sintered diffusion joining member to which a pressed powder member formed by compressing a metal powder and a metal member are joined by sintering, the method comprising:

sliding the metal member against the pressed powder member by rotating the metal member with a rotary motor in a circumferential direction around an axis at a rotational speed of about 10 revolutions per minute while applying a first surface pressure to the pressed powder member in a parallel direction with the axis to cause a sliding surface pressure of the pressed powder member against the metal member in a perpendicular direction to the central axis, the sliding surface pressure being about half of the first surface pressure;

temporarily joining the pressed powder member and the metal member by applying a second surface pressure to the pressed power material after sliding the metal member against the pressed powder member, the second surface pressure being greater than the sliding surface pressure; and sintering the temporarily joined pressed powder member and the metal member after applying the second surface pressure.

2. The method of manufacturing the sintered diffusion joining member according to claim 1, wherein a surface of the metal member is moved about 300 mm or less while sliding against the pressed powder member.

3. The method of manufacturing the sintered diffusion joining member according to claim 1, wherein the first surface pressure is within a range of 100 MPa to 500 MPa.

4. The method of manufacturing the sintered diffusion joining member according to claim 3, wherein the first surface pressure is about 400 MPa.

5. The method of manufacturing the sintered diffusion joining member according to claim 1, wherein the second surface pressure is about 700 MPa.

6. The method of manufacturing the sintered diffusion joining member according to claim 1, further comprising:

cooling the pressed powder member while the sliding the metal member against the pressed powder member by circulating a cooling fluid through a die that is in contact with the pressed powder member.

7. The method of manufacturing the sintered diffusion joining member according to claim 6, wherein the pressed powder member contains zinc stearate and cooling the pressed powder member while sliding the metal member against the pressed powder member including cooling the pressed powder member to a temperature that is less than a melting point of the zinc stearate contained in the pressed powder member.

8. The method of manufacturing the sintered diffusion joining member according to claim 1, wherein sliding the metal member against the pressed powder member includes rotating the metal member with the rotary motor in the circumferential direction around the axis at the rotational speed of about 10 revolutions per minute for a rotational time period of four seconds.

* * * * *